United States Patent [19]

Weinstein

[11] Patent Number: 4,919,333

[45] Date of Patent: Apr. 24, 1990

[54] ROTARY PAINT ATOMIZING DEVICE

[75] Inventor: Richard Weinstein, Toledo, Ohio

[73] Assignee: The DeVilbiss Company, Toledo, Ohio

[21] Appl. No.: 271,523

[22] Filed: Nov. 15, 1988

Related U.S. Application Data

[63] Continuation-in-part of Ser. No. 879,082, Jun. 26, 1986.

[51] Int. Cl.[5] ..... B05B 3/10

[52] U.S. Cl. ..... 239/223; 239/703

[58] Field of Search ..... 239/223, 224, 700–703

[56] References Cited

U.S. PATENT DOCUMENTS

| | | | |
|---|---|---|---|
| 3,552,652 | 1/1971 | Greenwood | 239/224 |
| 4,148,932 | 4/1979 | Tada et al. | 427/31 |
| 4,369,924 | 1/1983 | Morishita et al. | 239/703 |
| 4,373,672 | 2/1983 | Morishita et al. | 239/703 |
| 4,380,321 | 4/1983 | Culbertson et al. | 239/700 |
| 4,405,086 | 9/1983 | Vetter | 239/224 |
| 4,458,844 | 7/1984 | Mitsui | 239/703 |
| 4,467,968 | 8/1984 | Morishita et al. | 239/703 |
| 4,505,430 | 3/1985 | Rogers et al. | 239/112 |
| 4,519,549 | 5/1985 | Yokoe et al. | 239/703 |
| 4,643,357 | 11/1987 | Culbertson et al. | 239/112 |
| 4,684,064 | 8/1987 | Kwok | 239/224 |
| 4,776,520 | 10/1988 | Merritt | 239/703 |
| 4,838,487 | 6/1989 | Schneider | 239/224 |

FOREIGN PATENT DOCUMENTS

| | | | |
|---|---|---|---|
| 104394 | 4/1984 | European Pat. Off. | 239/223 |
| 922212 | 6/1947 | France . | |
| 1107060 | 3/1968 | United Kingdom | 239/703 |

*Primary Examiner*—Andres Kashnikow
*Assistant Examiner*—Michael J. Forman
*Attorney, Agent, or Firm*—MacMillan, Sobanski & Todd

[57] ABSTRACT

An improved rotary paint atomizing device in the form of a bell and a cover plate which is releasably attached to the front center of the bell. Paint fed along the axis of the device onto a conical projection on the back surface of the cover plate accelerates and flows outward in a radial direction. The cover plate surface is curved so that as the paint flows outwardly, it also flows first forward and then back until it reaches radial slots formed in a peripheral rim on the cover plate where the cover plate contacts an interior bell surface. Paint discharges from the slots onto a conical interior bell surface and flows in wide, closely spaced ribbons which merge into a uniform, continuous thin sheet before it is discharged from the bell edge. As the paint discharges from the bell edge, the sheet produces extremely fine uniform ligaments which break up to produce fine, uniform small paint particles.

24 Claims, 2 Drawing Sheets

ROTARY PAINT ATOMIZING DEVICE

CROSS REFERENCE TO RELATED APPLICATION

This application is a continuation in part of my earlier copending application Ser. No. 06/879,082, filed Jun. 26, 1986.

TECHNICAL FIELD

The invention relates to rotary paint atomizers and more particularly to an improved rotary paint atomizing device for electrostatic coating which provides a very fine uniform paint atomization.

BACKGROUND ART

Electrostatic applicators are commonly used for industrial coating applications because of their high transfer efficiency. Generally paint is atomized either through the use of compressed air or through very high paint pressure or through centrifugal force. Centrifugal atomization is accomplished by supplying a flow of paint to a surface of a device such as a disk or, preferably, a cup or bell shaped device, which is rotated at a very high speed, for example, at from 10,000 to 60,000 revolutions per minute, or more. When the paint is thrown from the edge of the rotating device by centrifugal force, it is atomized or broken up into small particles. As the paint is atomized, an electrostatic charge is imparted to the paint droplets, for example, by maintaining the rotating device at a very high voltage relative to a workpiece which is being coated. The paint particles are charged at a polarity opposite to the workpiece and are drawn through the electrostatic force to the workpiece.

The most commonly used rotary device for atomizing paint is a bell which has an interior conical surface leading to the discharge edge. The bell has an internal web or wall separating a rear chamber from the front conical surface. Paint is initially supplied to the rear chamber and is forced by centrifugal force to flow through a plurality of small circumferentially spaced holes to the conical surface. The holes serve the function of providing a more uniform paint distribution on the conical surface. In the past, the holes had to be drilled through the bell wall with a greater hole spacing than the diameter of the holes. The paint flow from the holes attaches itself to the conical bell surface as ribbons. The ribbons of paint have so much space between them, that they do not join into a uniform continuous sheeting surface at the bell discharge edge. The separate ribbons can result in the paint leaving the discharge edge in relative course, irregular sheets. From the sheets, the paint forms irregular ligaments or filaments which break up into irregular sized paint particles. This effect can be reduced by increasing the size of the bell so that the paint travels further over the bell surface. When the paint film remains on the bell surface longer, it becomes thinner and more uniform at the discharge edge, thus producing finer ligaments and smaller droplets. However, a larger bell produces significantly higher loads on the drive shaft bearings since the bell is rotated at very high speeds.

The design of the rotary atomizing device is an art wherein very small design changes may significantly effect the quality of the coating applied to a workpiece. It is known, for example, that if the paint is discharged from a sharp edge on the bell, air will be entrained in the paint particles and will produce a poor quality finish. One advance in the rotary atomizer art has been the discovery that by rounding at least the outer edge of the bell where the paint is discharged, less air is entrained in the paint and an improved finish is achieved. Another advance was the discovery that by producing a large number of small radially directed grooves in the interior conical bell surface leading to the discharge edge, the paint is forced to flow to the bell edge in a greater number of finer and more uniform streams, rather than in the wider ribbons. The paint is discharged from the bell edge in fine filaments or ligaments rather than in larger, irregular sheets which break up into more coarse and irregular filaments and then into irregular sized atomized paint particles. However, forming the grooves on the inside surface of the bell is expensive and the grooves are limited in their capability of producing uniform small atomized particles, probably due to the limited number of grooves at the bell edge. High paint flow rates and small bell diameter also limit the capability of the grooves in producing fine atomization.

DISCLOSURE OF INVENTION

It has been found that improved atomization can be achieved by increasing the uniformity and thinness of the paint film at the bell edge, rather than providing grooves in the bell edge. An improved bell type rotary paint atomizing device according to this invention is manufactured from two pieces, a bell and a splash or cover plate, which may be separated from the bell to facilitate manufacturing and cleaning. The cover plate covers the center of the bell to define a paint receiving chamber. Paint is supplied through an axial feed tube and is flowed onto a conical projection on the rear of the cover plate. Centrifugal force causes the paint to flow forward and outward radially along the back of the cover plate. As the diameter increases, the rear surface on the cover plate is curved back onto itself so that the paint is directed backward from its original direction as it moves radially in an outward direction. This has the advantage of reducing the axial length of the bell without reducing the length of the paint flow path. A shorter bell produces less overhang load or moment of a very high speed rotating shaft on its bearings. The paint exits the chamber radially through a plurality of small radial slots milled in a rim at the rear circumference of the cover plate where it contacts the inner conical bell surface. Paint forced by centrifugal force through the slots form uniform, closely spaced streams which attach onto the conical interior bell surface.

The result of the design of the device is to provide wide, closely spaced, uniform ribbons of paint at the locations the paint flows onto the interior conical bell surface. These wide, closely spaced ribbons further widen and become thinner as they move outwardly on the larger conical bell surface until they join and form a continuous thin uniform sheet by the time the bell edge is reached. In existing prior art bell designs, paint flows from small holes on a front central bell surface in the form of small streams or ribbons which exit at the base of small holes. The ribbons of paint have so much space between them, that they do not join into a continuous sheeting surface at the bell edge. In the prior art bell, the central web or wall through which the paint holes are drilled is an integral part of the bell. Only a limited number of holes can be drilled through the wall for paint to flow from the paint receiving chamber to the conical interior bell surface. The design of the bell of the present invention permits the cover plate slots and the curved inner surface to be easily machined and also permits the user to easily remove the cover plate to clean and examine all interior surfaces of the bell. Also, the number of slots and the size of the slots in the cover plate can be varied to suit the properties of the paint being used, thereby aiding in achieving a desired finish on a workpiece without the expense of purchasing a different atomizer device. More than one removable center plate can be sold with each bell to facilitate use of the bell with different coating materials.

Accordingly, it is an object of the invention to provide an improved rotary paint atomizing device.

Other objects and advantages of the invention will be apparent from the following detailed description and the attached drawings.

BEST MODE FOR CARRYING OUT THE INVENTION

Figure 1:
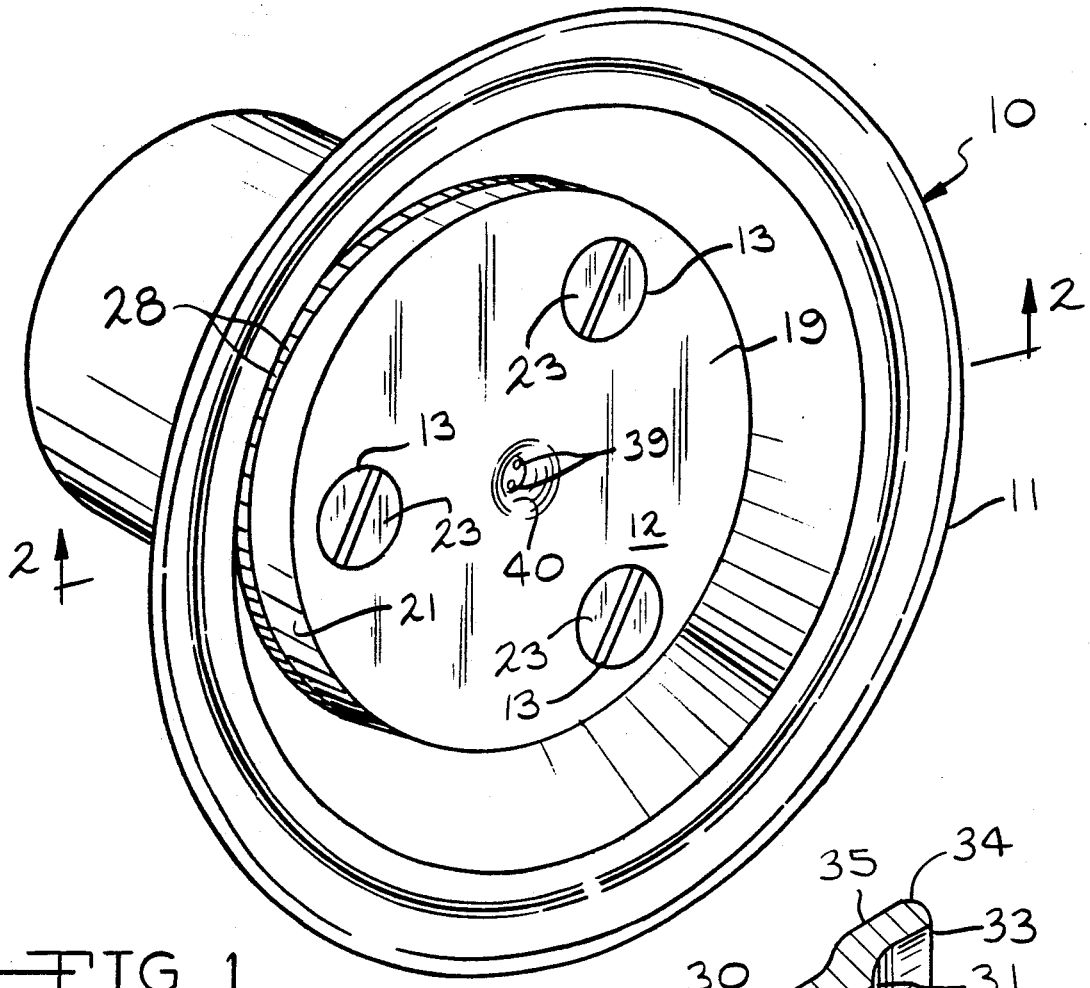
FIG. 1 is a front perspective view of a rotary atomizing device in accordance with the invention.
Figure 2:
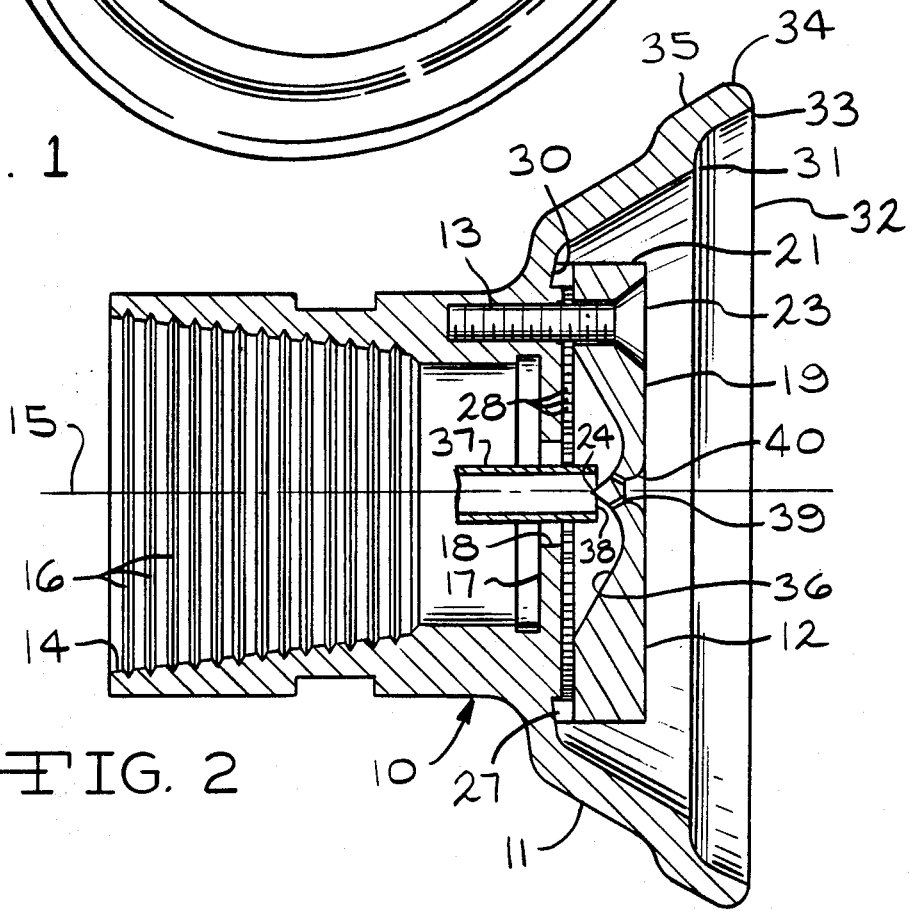
FIG. 2 is a side cross sectional view as taken along line 2—2 of FIG. 1.

Turning to FIGS. 1 and 2 of the drawings, an improved rotary paint atomizing device 10 is shown in accordance with a preferred embodiment of the invention. The device 10 generally comprises a bell 11, a cover plate 12 and a plurality of screws 13 which attach the cover plate 12 to the bell 11. The screws 13 permit removal of the cover plate 12 from the bell 11 for cleaning and inspecting interior surfaces on both the cover plate 12 and the bell 11. Removal of the cover plate 12 also permits changing the cover plate 12 if damaged or worn or when required for different coating materials. The cover plate 12 may become worn over a period of time, for example, by errosion caused by abrasive coating fluids.

The bell 11 is shown as having a tapered rear opening 14 for attachment to the shaft of a motor (not shown), such as a high speed air driven turbine. The motor rotates the device 10 about an axis 15 at speeds, for example, of between 10,000 and 60,000 revolutions per minute. As is known in the art, the opening 14 may have a plurality of grooves 16 which facilitate both alignment of the bell on a turbine shaft and removal of the bell from the turbine shaft. Of course, any known method for attaching the bell to a motor shaft may be used. A wall 17 having a central opening 18 is located at the end of the opening 14.

Figure 4:
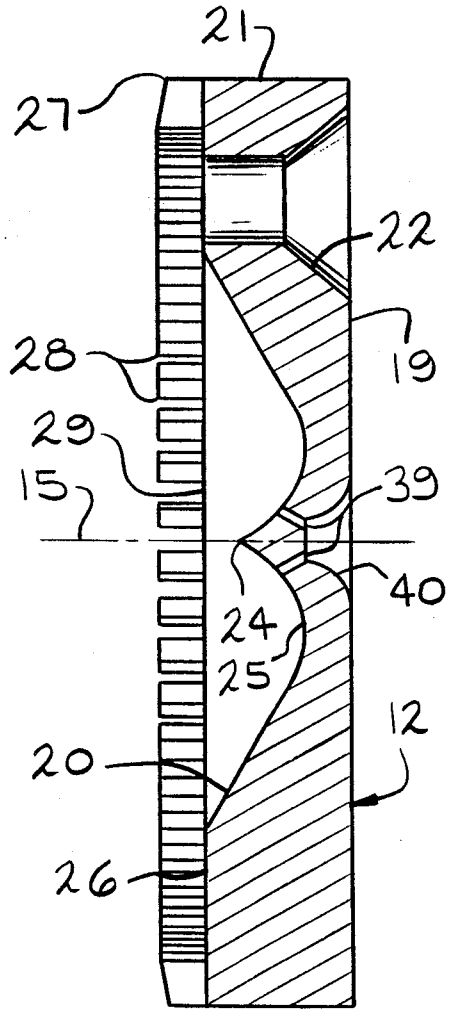
FIG. 4 is a cross sectional view as taken along line 4—4 of FIG. 3.
Figure 3:
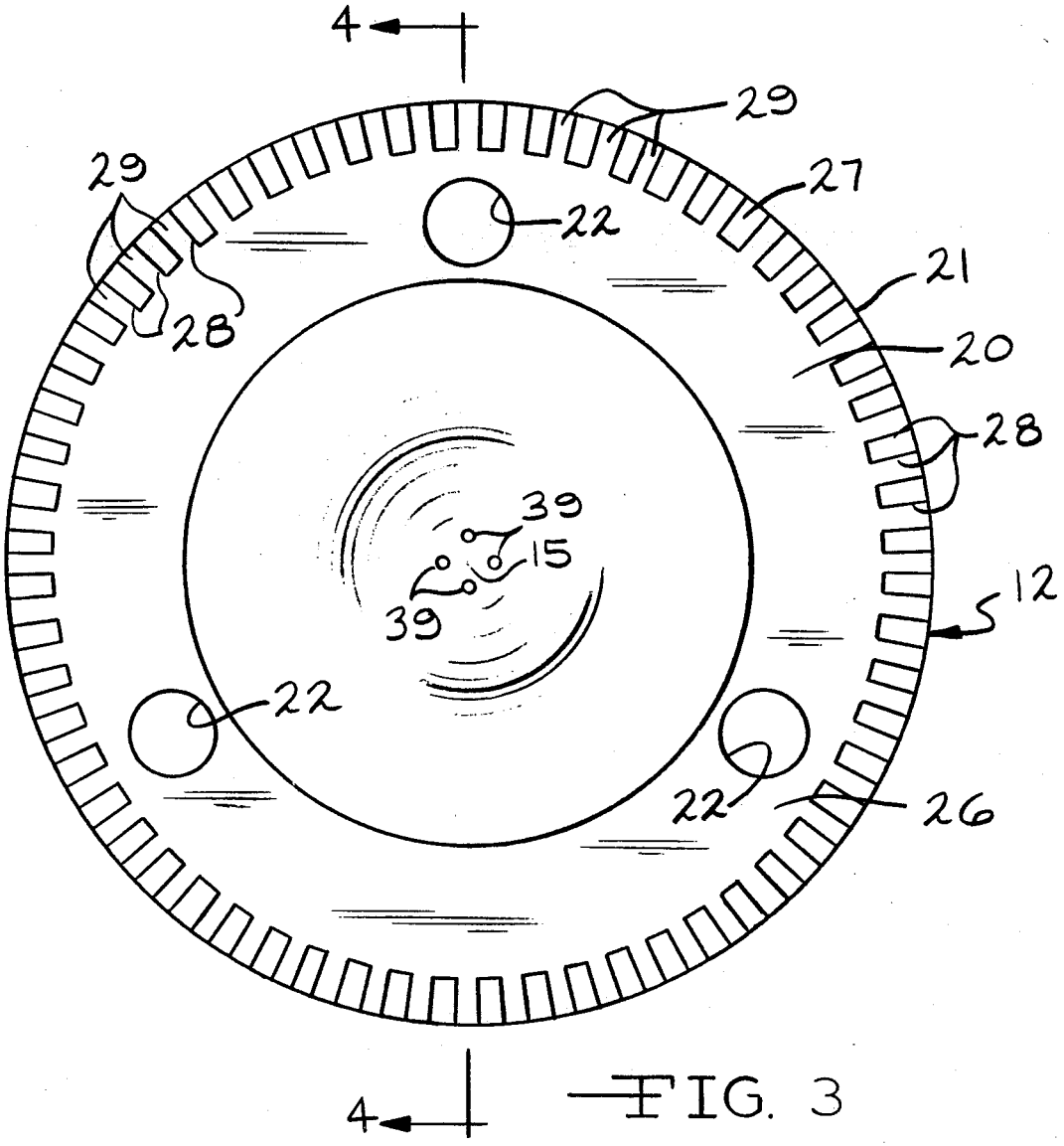
FIG. 3 is an enlarged rear view of the front cover plate for the rotary atomizing device of FIG. 1.

Details of the cover plate 12 are shown in FIGS. 3 and 4. The cover plate 12 is generally in the form of a disc having a substantially flat front surface 19 and a shaped rear surface 20 connected at a circumferential edge 21. A plurality of holes 22 are formed through the cover plate 12 for receiving the screws 13. The holes 22 are countersunk so that flat head surfaces 23 on the screws 13 (see FIG. 2) extend coplanar with the front surface 19 on the cover plate 12.

The rear cover plate surface 20 has at its center a rearwardly directed conical projection 24. The rear surface 20 is symmetrical about the bell axis 15. Moving in a radial direction from the projection 24, the surface 20 curves forward toward the front surface 19 to a location 25 and thence curves rearwardly to a planar surface 26. By having the surface 20 curve first forward and then reward when moving in a radial direction from the axis 15, the axial length of the bell 11 is reduced. Prior art rotary atomizer bells flow the paint in a forward and radial direction, thus requiring a greater axial length than is required by the device 10. The shorter length helps reduce bearing load caused by high speed imbalance multiplied by the amount of bell overhang from the front edge of the bearing as a ratio of the overhang to the full bearing supported shaft. The reward direction of the paint flow also permits a longer internal conical expanding surface for the paint to sheet itself on before reaching the bell discharge edge. The greater the expanding sheeting surface, the thinner the paint film cross section becomes and the wider the ribbon at the bell edge. This thinner continuous sheet at the bell edge will break up into thinner ligaments which in turn provide smaller atomized particles and a smoother surface finish on the workpiece.

The surface 26 terminates at a rearwardly projecting rim 27. The rim 27 contacts the bell 11 when the cover plate 12 is attached to the bell 11. A large plurality of uniform, closely spaced radial slots 28 are machined into the rim 27. For example, a cover plate of about 30 mm in diameter may have 60 slots 28 machined in the rim 27. Each of the slots 28 has a bottom 29 which may extend coplanar with the surface 26.

Referring again to FIGS. 1 and 2 when the cover plate 12 is attached to the bell 11, the rim 27 contacts an inner surface 30 on the bell 11. The bell surface 30 is symmetrical about the axis 15. Moving in a radial direction from the point that the rim 27 contacts the surface 30, the surface 30 has a forwardly directed conical shape until it reaches a step 31. At the step 31, there is an increase in diameter and from the step 31 the surface 30 continues with a larger forwardly opening conical shape to a front paint discharge edge 32. The step 31 functions to increase the flow velocity of the paint film as it moves toward the discharge edge 32. As the velocity of the paint increases, the paint film thickness will be reduced. Preferably, at a junction 33 of the surface 30 at the front edge 32, the bell forms a relatively sharp corner and a radius is formed at a junction 34 between the front edge 32 and an outer bell surface 35. As is taught in the prior art, this construction at the front edge 32 reduced entrapped air in the atomized paint.

When the cover plate 12 is attached to the bell 11, a chamber 36 is defined between the rear cover plate surface 20 and the wall 17. A paint feed tube 37 (shown in fragmentary) extends along the axis 15, through the opening 18 and into the chamber 36. The paint feed tube 37 is mounted in the turbine to extend coaxially through the turbine shaft and is connected to a conventional paint source. The paint feed tube 37 directs paint axially onto the adjacent cover plate projection 24. Preferably, the paint feed tube 37 is positioned with the cover plate projection 24 extending slightly into an open end 38 of the paint feed tube 37. In prior art rotary atomizer devices of this type, paint discharged from a feed tube into a rear bell chamber tended to splash because its initial contact was with a surface moving at a high speed. Splashing adversely affects the coating quality and the load on the bearing supporting the device.

In operation of the device 10, paint flows from the tube 37 smoothly onto the cover plate surface 20, beginning at the projection 24, and flows through centrifugal force radially outwardly to the slots 28. Since the surface speed of the projection 24 adjacent the axis 15 is near zero, the paint attaches itself to the projection 24 and is smoothly accelerated without splashing as it moves in a radial direction. Some quantity of paint will build up in the chamber 36 at the slots 28, thus providing for a uniform paint flow through all of the slots 28. As the paint leaves the slots 28, it forms relatively wide, closely spaced ribbons on the bell surface 30. Centrifugal force will cause the paint ribbons to move forward and outward along the conical surface 30. At the same time, the paint film will become thinner and the ribbons will widen into a continuous uniform sheet by the time it reaches the edge 32. As the sheet of paint is discharged from the edge 32, it breaks up first into very fine filaments or ligaments and then into a cloud of very fine droplets. Either directly or indirectly, an electrostatic charge is imparted to the atomized paint droplets. The charge may be imparted to the droplets, for example, either directly by charging the bell 11 to a very high voltage relative to the workpiece or indirectly by creating a strong electrostatic field in the vicinity of the paint discharge edge 32. The charge imparted to the droplets is at a polarity opposite to the voltage on the workpiece being coated. The charge differential draws the atomized droplets onto the workpiece. If desired, an air curtain may be formed adjacent to and surrounding the paint discharge edge 32 to help direct the atomized paint towards the workpiece.

Some of the atomized paint droplets may be drawn onto the cover plate 12 at the front of the bell 11. The front of the bell 11, in this case the cover plate 12, is more easily cleaned by flowing a small percentage of the paint supplied by the feed tube 37 over the front surface 19. This is accomplished by forming a plurality of passages 39 through the cover plate 12 near its center. The passages 39 are formed to extend from the side of the conical projection 24 on the rear surface 20 to angle inwardly to a recess 40 at the center of the front surface 19.

The optimum size and number of slots 28 will be determined by various factors including the flow properties of the paint, the desired flow rate and the rotational speed of the atomizer. Thus, different cover plates 12 may be required for different applications. By attaching the cover plate 12 with screws, the cover plate 12 is readily changed if a different cover plate configuration is required when changing coating materials or application rates. Also, easy removal of the cover plate facilitates cleaning and inspecting the surfaces of the chamber 36 and the slots 28. When abrasive materials are applied with the device 10, the slots 28 may eventually become worn. Easy removal of the cover plate 12 also permits replacement of only a worn cover plate 12, rather than requiring replacement of the entire atomizer device when the paint holes are worn.

It will be appreciated that various modifications and changes may be made to the rotary paint atomizer device 10 without departing from the spirit and the scope of the following claims.

I claim:

1. An improved rotary paint atomizer device comprising a bell adapted to be rotated about an axis at high speeds, said bell having a front side defining an interior wall connecting with an interior generally conical surface, said conical surface extending symmetrical about said axis to a forward paint discharge edge, a paint receiving chamber located on said axis, a stationary axial paint feed tube having a forwardly directed discharge end located in said chamber on said axis, said chamber having a forward surface rotated with said bell defining a conical projection on said axis which extends at least to adjacent said tube discharge end, said projection receiving paint from said tube, means for feeding paint from said chamber onto said conical bell surface, and a plurality of small straight passages extending from said conical projection on said forward chamber surface at a location spaced from said axis to said interior wall to deliver a limited portion of the paint delivered to said chamber to flow across said interior wall and said conical surface to said discharge edge.

2. An improved rotary paint atomizer device, as set forth in claim 1, wherein said forward chamber surface curves in a radial direction from said axis first forward and than rearward to said means for feeding paint from said chamber onto said conical bell surface.

3. An improved rotary paint atomizer device, as set forth in claim 2, wherein said means for feeding paint comprises a plurality of passages extending from said chamber radially toward said conical bell surface.

4. An improved rotary paint atomizer device, as set forth in claim 3, wherein said forward chamber surface is formed on a cover plate, wherein said plurality of passages are formed between said cover plate and said bell, and including means for releasably attaching said cover plate to said bell.

5. An improved rotary paint atomizer device, as set forth in claim 2, wherein said forward chamber surface is formed on a cover plate, and including means for releasably attaching said cover plate to said bell.

6. An improved rotary paint atomizer device, as set forth in claim 1, wherein said forward chamber surface is formed on a cover plate, and including means for releasably attaching said cover plate to said bell.

7. An improved rotary paint atomizer device, as set forth in claim 6, wherein said conical projection extends into said tube discharge end.

8. An improved rotary paint atomizer device, as set forth in claim 1, wherein said plurality or small straight passages project forwardly and inwardly towards said axis from said forward chamber surface to said interior wall.

9. An improved rotary paint atomizer device, as set forth in claim 1, wherein said interior wall includes a central recess having a surface coaxial to and radially spaced from said axis, and wherein said plurality of small straight passages terminate at said central recess surface.

10. An improved rotary paint atomizer device comprising a bell adapted to be rotated about an axis at high speeds, said bell having a front defining an interior wall connecting with an interior generally conical surface, said surface extending symmetrical about said axis to a paint discharge edge, a circular cover plate having front and rear surfaces, means for releasably attaching said cover plate coaxially to said bell front, said bell wall and said cover plate defining a paint receiving chamber, said rear surface forming one side of said chamber, said cover plate having an outer edge forming a rim which contacts, said bell front, a plurality of circumferentially spaced uniform radial slots formed through said rim, said slots causing paint to flow through centrifugal force from said chamber through said slots and onto said conical bell surface as a plurality of uniform streams which merge into a continuous uniform sheet as such paint flows along said interior conical surface to said discharge edge, and a plurality of small passages extending from said rear surface at a location spaced from said axis to said front surface at a location adjacent to said axis, whereby a limited portion of the paint delivered to said chamber flows through said passages and across said front surface.

11. An improved rotary paint atomizer device, as set forth in claim 10, wherein paint is delivered into said chamber from a coaxial paint feed tube extending through an axial opening in said wall.

12. An improved rotary paint atomizer device, as set forth in claim 11, wherein said rear surface extends symmetrical about said bell axis and has a rearwardly directed conical projection located on said axis to extend at least to adjacent an open end of said feed tube for receiving paint, and wherein said rear surface curves in a radial direction from said projection first forwardly and then rearwardly to said rim.

13. An improved rotary paint atomizer device, as set forth in claim 12, wherein said conical projection extends into said open feed tube end.

14. An improved rotary paint atomizer device, as set forth in claim 10, wherein said means for releasably attaching said cover plate to said bell comprises a plurality of screws passing through said cover plate and threadably engaging said bell.

15. An improved rotary paint atomizer device, as set forth in claim 10, wherein said interior conical surface on said bell includes a step providing an increased diameter between two forwardly opening conical surface sections to increase the velocity of the paint film flowing over said conical bell surface to said discharge edge.

16. An improved rotary paint atomizer device comprising a bell adapted to be rotated about an axis at high speeds including a generally cup-shaped member having an annular front flow surface which extends generally outwardly relative to said axis of rotation and which terminates at an outer paint discharge edge, an annular plate extending across said cup-shaped member and defining a rear surface terminating at an annular outer portion and a front surface, said rear surface having a rearwardly projecting conical portion symmetrical about said axis, a plurality of first passages extending through said outer portion for delivering paint from said rear surface through said plate to said annular front flow surface, paint feed tube means having a discharge end located on said axis for directing a flow of paint axially onto said cover plate conical portion, such paint flowing radially outwardly along said rear surface toward said first passages, and at least one second passage extending through said plate, said second passage having an inlet on said conical portion radially offset from said axis and an outlet at a central portion of said plate front surface.

17. An improved rotary paint atomizer device according to claim 16 wherein said second passage is angled from a location spaced from said axis on said conical projection to the intersection of said axis with said central portion.

18. An improved rotary paint atomizer device according to claim 16 wherein said conical projection extends into said outlet of said feed tube.

19. An improved rotary paint atomizer device according to claim 16 wherein said first passages extend in a radial direction.

20. An improved rotary paint atomizer device according to claim 19 wherein said rear surface is symmetrical about said axis and curves in a radial direction from said conical portion rearwardly to said annular outer portion.

21. An improved rotary paint atomizer device according to claim 20 wherein said annular outer portion of said rear surface is located to the rear of said conical portion.

22. An improved rotary paint atomizer device according to claim 16 wherein at least a portion of said plate is detachably mounted on said bell.

23. An improved rotary paint atomizer device comprising a bell adapted to be rotated about an axis at high speeds, said bell having a front side defining an interior wall connecting with an interior generally conical surface, said conical surface extending symmetrical about said axis to a forward paint discharge edge, a paint receiving chamber located on said axis, said chamber having a forward surface rotated with said bell, a stationary axial paint feed tube having a forwardly directed discharge end located in said chamber on said axis, said tube directing paint along said axis at said forward surface, means for feeding paint from said chamber onto said conical bell surface, and a plurality of small straight passages extending from said forward chamber surface at a location spaced from said axis to said interior wall to deliver a limited portion of the paint delivered to said chamber to flow across said interior wall and said conical surface to said discharge edge.

24. An improved rotary paint atomizer device, as set forth in claim 23, wherein said interior wall includes a central recess having a surface coaxial to and radially spaced from said axis, and wherein said plurality of small straight passages terminate at said central recess surface.

* * * * *